US005981160A

United States Patent [19]

Odenwälder et al.

[11] Patent Number: 5,981,160

[45] Date of Patent: Nov. 9, 1999

[54] COLOR PHOTOGRAPHIC SILVER HALIDE MATERIAL

[75] Inventors: Heinrich Odenwälder, Leverkusen; Hans Langen, Bonn; Jörg Hagemann; Klaus Henseler, both of Köln, all of Germany

[73] Assignee: Agfa-Gevaert AG, Germany

[21] Appl. No.: 09/053,920

[22] Filed: Apr. 2, 1998

[30] Foreign Application Priority Data

Apr. 9, 1997 [DE] Germany ..... 197 14 614

[51] Int. Cl.[6] ..... G03C 1/08; G03C 7/26; G03C 7/32

[52] U.S. Cl. ..... 430/551; 430/502; 430/543; 430/607

[58] Field of Search ..... 430/551, 607, 430/502, 543

[56] References Cited

U.S. PATENT DOCUMENTS

| | | | |
|---|---|---|---|
| 4,366,240 | 12/1982 | Lässig et al. | 430/542 |
| 4,369,243 | 1/1983 | Credner et al. | 430/223 |
| 4,444,867 | 4/1984 | Credner | 430/543 |
| 5,367,008 | 11/1994 | Nesvadba | 524/111 |

FOREIGN PATENT DOCUMENTS 197 49 083 A1 7/1998 Germany .

*Primary Examiner*—Geraldine Letscher
*Attorney, Agent, or Firm*—Connolly Bove Lodge & Hutz LLP

[57] ABSTRACT

A colour photographic silver halide material which contains in at least one layer at least one compound of the general formula (I)

(I)

in which $R_1$ means hydrogen, alkyl or acyl, $R_2$, $R_3$ mutually independently mean alkyl, cycloalkyl, alkenyl, aryl, halogen, $OR_4$, $SR_5$, $NR_6R_7$, nitro, cyano, $SO_2R_8$, $COOR_9$, $COR_{10}$ or hetaryl, $R_4$, $R_5$, $R_9$ mutually independently mean alkyl, cycloalkyl, alkenyl, aryl or hetaryl, $R_6$, $R_7$ mutually independently mean H, $R_4$, $COR_{10}$, $COOR_9$, $SO_2R_8$, $R_8$, $R_{10}$ mutually independently mean alkyl, cycloalkyl, alkenyl, aryl, hetaryl or $NR_6R_7$, n, m mean 0, 1, 2, 3 or 4 or two residues $R_2$ or $R_3$ may each mean a fused carbo- or heterocyclic ring or the compounds of formula I are linked to a polymer chain via $R_1$, $R_2$ or $R_3$ is distinguished by elevated storage stability.

10 Claims, No Drawings

COLOR PHOTOGRAPHIC SILVER HALIDE MATERIAL

This invention relates to a colour photographic silver halide material having improved properties.

The practical requirements placed upon DOP scavengers (scavenging reagents for the developer oxidation product) in colour photographic silver halide materials (colour film and colour paper) are a) elevated efficacy, i.e. effective avoidance of unwanted co-coupling, b) extended stability in storage, i.e. avoidance of losses in activity by oxidation before processing;

c) no impairment of image stability, i.e. in the case of film, for example, avoidance of post coupling, in the case of paper, for example, stability of the dyes against moisture, heat and light.

So-called white couplers or compounds having a redox action are used to perform these tasks. These are conventionally either pyrazolone couplers having a methyl group at the coupling site or non-diffusible hydroquinones, disulphonamidophenols and N-aryl-N'-acylhydrazines. These compounds are not, however, capable of adequately fulfilling practical requirements as described above.

It has now been found that surprising improvements may be achieved with certain benzofuranones.

The present invention accordingly provides a colour photographic silver halide material having a support and at least one photosensitive silver halide emulsion layer, which material contains in at least one layer at least one compound of the general formula(I):

(I)

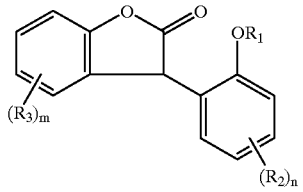

in which $R_1$ means hydrogen, alkyl or acyl, $R_2$, $R_3$ mutually independently mean alkyl, cycloalkyl, alkenyl, aryl, halogen, $OR_4$, $SR_5$, $NR_6R_7$, nitro, cyano, $SO_2R_8$, $COOR_9$, $COR_{10}$ or hetaryl, $R_4$, $R_5$, $R_9$ mutually independently mean alkyl, cycloalkyl, alkenyl, aryl or hetaryl, $R_6$, $R_7$ mutually independently mean H, $R_4$, $COR_{10}$, $COOR_9$, $SO_2R_8$, $R_8$, $R_{10}$ mutually independently mean alkyl, cycloalkyl, alkenyl, aryl, hetaryl or $NR_6R_7$, n, m mean 0, 1, 2, 3 or 4 or two residues $R_2$ or $R_3$ may each mean a fused carbo- or heterocyclic ring or the compounds of formula I are linked to a polymer chain via $R_1$, $R_2$ or $R_3$. At least one of the residues $R_2$ and $R_3$ is preferably located in para position relative to the phenolic oxygen.

Acyl residues $R_1$ can be residues of an aromatic or aliphatic carboxylic acid, carbamic acid, carbonic acid, sulfonic acid, sulfinic acid or phosphonic acid.

The linkage to a polymer chain can be accomplished with an unsaturated group, e.g. a styrene, acrylic acid or methacrylic acid group.

A suitable monomer is e.g.:

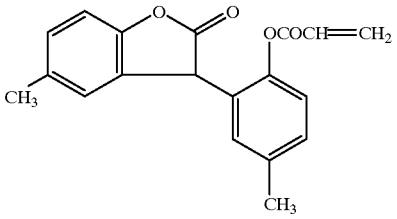

The linkage to a polymer chain can further be accomplished by a polymer analogous reaction. E.g. the compound of the following formula

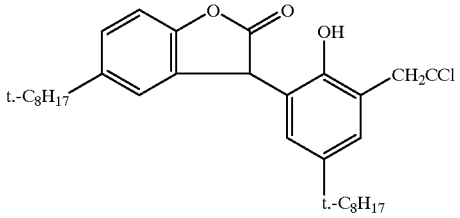

can become part of a polymer as follows

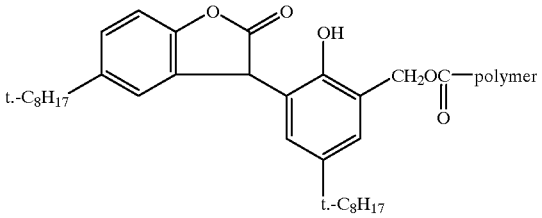

In a preferred embodiment, $R_2$ is identical to $R_3$ and n is identical to m.

Preferably, $R_1$ means hydrogen or acyl and $R_2$ and $R_3$ mean alkyl, wherein the sum of the C atoms in the alkyl residues $R_2$ and $R_3$ is $\geqq 8$. Preferred acyl residues are the residues of aromatic or aliphatic carboxylic acids.

Examples of compounds of the formula (I), in which $R_1$ is hydrogen, are:

| No. | $R_2$=$R_3$ |
|---|---|
| I-1 | 4-t-$C_4H_9$ |
| I-2 | 4-$CH_3$ |
| I-3 | 4-$CH(CH_3)_2$ |
| I-4 | 4-t-$C_8H_{17}$ |
| I-5 | 4-i-$C_9H_{19}$ |
| I-6 | 4-i-$C_{12}H_{25}$ |
| I-7 | 4-Cyclopentyl |
| I-8 | 4-Cyclohexyl |
| I-9 | 2-$CH_3$-4-$CH_3$ |
| I-10 | 2-$CH_3$-4-t-$C_8H_{17}$ |
| I-11 | 2-t-$C_4H_9$-4-$CH_3$ |
| I-12 | 2-t-$C_4H_9$4-t-$C_4H_9$ |
| I-13 | 2-$(CH_3)_2$-phenyl-4-$(CH_3)_2$-phenyl |
| I-14 | 2-t-$C_4H_9$-4-$(CH_2)_2CO_2CH_3$ |
| I-15 | 2-t-$C_4H_9$-4-$OCH_3$ |
| I-16 | 2-Cl-4-Cl |
| I-17 | 2-Phenyl-4-$OC_4H_9$ |
| I-18 | 2-NHCO-i-$C_7H_{15}$-4-O—$COOC_2H_5$ |

-continued
| No. | $R_2$=$R_3$ |
|---|---|
| I-19 | 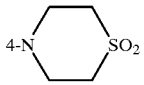 |
| I-20 | 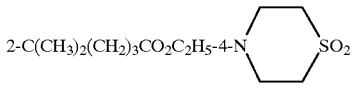 |
| I-21 | 2-S$(CH_2)_{11}CH_3$-4-$CH_3$ |
-continued
| No. | $R_2$=$R_3$ |
|---|---|
| I-22 | 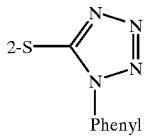 |
| | -4-t-$C_8H_{17}$ |
| I-23 | 4-$C(CH_3)_2$-phenyl |
| I-24 | 4-$CO_2C_{12}H_{25}$ |
| I-25 | 3-$CH_3$-4-$CH_3$ |
The position of the substituents is relative to the oxygen. Position 3 is in para position relative to the second ring linkage.
Further examples are:
| No. | $R_2$=$R_3$ |
|---|---|
| I-26 | 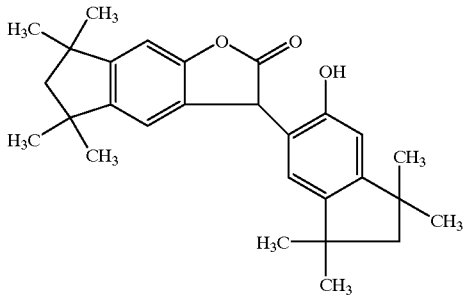 |
| I-27 | 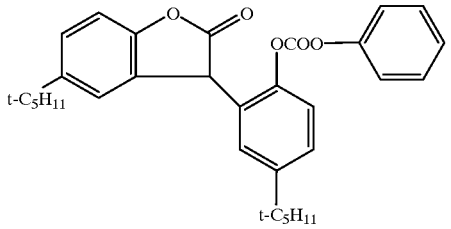 |
| I-28 | 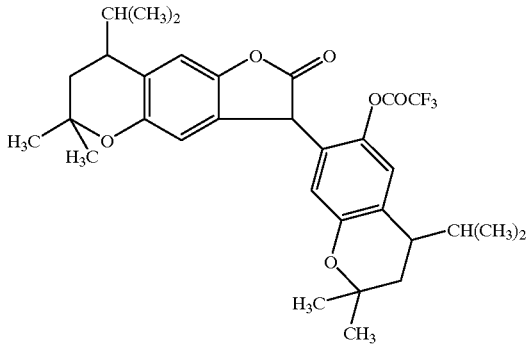 |

-continued
| No. | $R_2$=$R_3$ |
|---|---|
| I-29 | 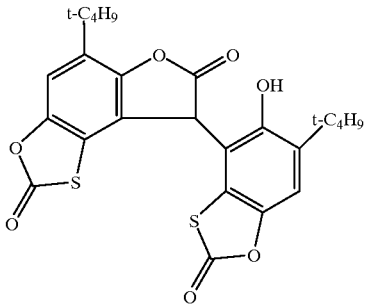 |
| I-30 | 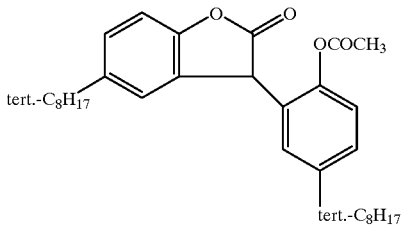 |
| I-31 | 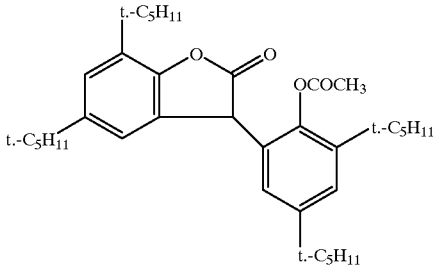 |
| I-32 | 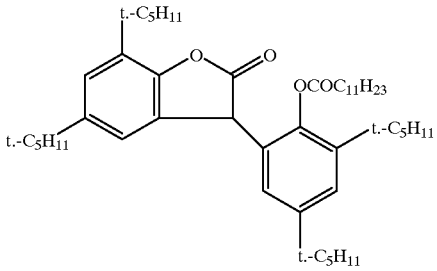 |
| I-33 | 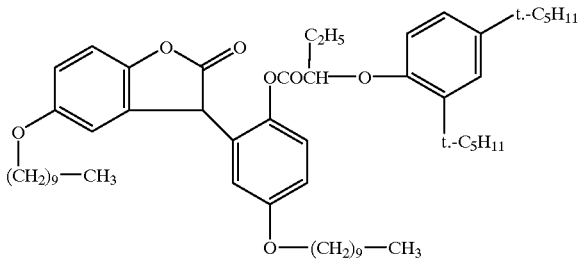 |

-continued

| No. | $R_2$=$R_3$ |
|---|---|
| I-34 | 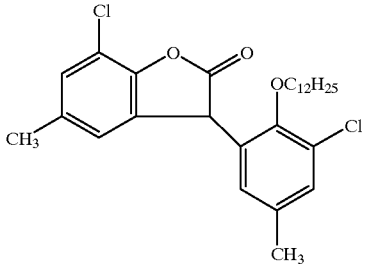 |
| I-35 | 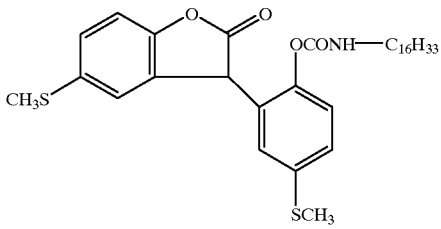 |
| I-36 | 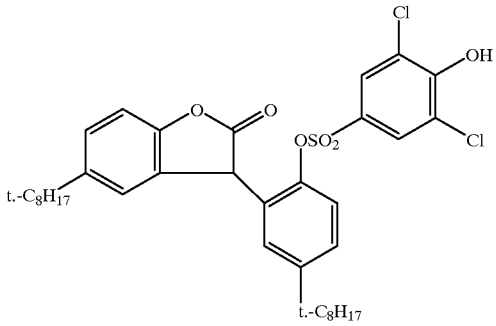 |
| I-37 | 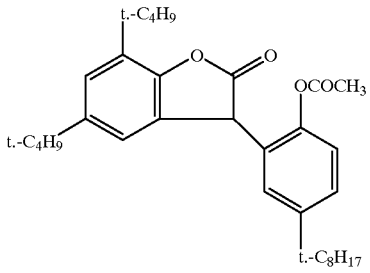 |
| I-38 | 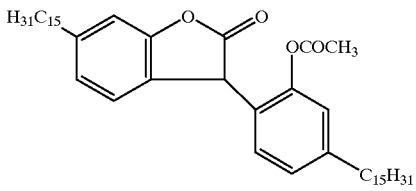 |

Production of Compound I-4

24.4 ml of an aqueous, 50 wt. % oxoacetic acid and then 91.7 g of 4-(1,1,3,3-tetra-methylbutyl)phenol are added at room temperature to a mixture of 500 ml of glacial acetic acid and 90 ml of concentrated sulphuric acid. After overnight stirring, the resultant precipitate is removed by suction filtration and washed with glacial acetic acid and then with water.

After drying, 81.1 g (90% of theoretical) of compound I-4 are obtained having a melting point of 125 to 127° C.

The other stated compounds are obtained in a corresponding manner. In the event of diminished reactivity of the phenolic compound, more severe reaction conditions may be necessary, for example by increasing temperature, increasing the concentration of sulphuric acid, performing the reaction in a melt etc. The sulphuric acid may furthermore be entirely or partially replaced by other acids, for example by p-toluenesulphonic acid, methanesulphonic acid, phosphoric acid, polyphosphoric acid, phthalic acid, trifluoroacetic acid, boric acid and the like. Compounds of formula I, in which $R_1$ means an acyl residue are easily obtained from compounds of formula I wherein $R_1$ denotes hydrogen by known methods applying carboxylic acid anhydrides or carboxylic acid chlorides, for example.

The compounds of the formula (I) are preferably used in a quantity of 5 to 1000 mg/$M^2$, in particular of 10 to 500 mg/$r^2$.

The compounds of the formula (I) may also assume salt form (phenolate); suitable cations are metal cations and ammonium ions, in particular alkali metal ions and tri- or tetraalkyl ammonium ions.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sublayers are generally arranged closer to the support than the more highly sensitive sublayers.

A yellow filter layer is conventionally located between the green-sensitive and blue-sensitive layers which prevents blue light from penetrating into the underlying layers.

Possible options for different layer arrangements and the effects thereof on photographic properties are described in *J. Inf. Rec. Mats.*, 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide or silver bromide-iodide-chloride emulsions. Photographic print materials contain either silver chloride-bromide emulsions containing up to 80 wt. % of AgBr or silver chloride-bromide emulsions containing above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995); page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents.

These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq., The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 el seq. together with example materials.

The compounds of the formula (I) are in particular used in at least one layer adjacent to a green-sensitive silver halide emulsion layer containing at least one magenta coupler, the silver halide emulsion of which layer is a silver bromide-chloride emulsion containing at least 95 mol. % of AgCl.

In this case, pyrazolotriazole magenta couplers may in particular be considered as the magenta coupler.

EXAMPLE 1

A colour photographic recording material was produced by applying the following layers in the stated sequence onto a film support made of paper coated on both sides with polyethylene. All quantities are stated per 1 $m^2$. The quantity of silver halide applied is stated as the corresponding quantity of $AgNO_3$.

SAMPLE 1

Layer 1: (Substrate layer)
0.2 g of gelatine

Layer 2: (Blue-sensitive layer)
Blue-sensitive silver halide emulsion (99.5 mol. % chloride, 0.5 mol. % bromide, average grain diameter (0.8 μm) prepared from 0.45 g of $AgNO_3$ with
1.18 g of gelatine
0.55 g of yellow coupler Y-1
0.1 g of white coupler W-1
0.2 g of dye stabiliser ST-1
0.29 g of oil former OF-1
0.10 g of oil former OF-2

SAMPLE 1-continued

Layer 3: (Protective layer)
1.10 g of gelatine
0.07 g of compound SC-1
0.07 g of compound SC-2
0.07 g of tricresyl phosphate (TCP)

Layer 4: (Green-sensitive layer)
Green-sensitised silver halide emulsion (99.5 mol. % chloride, 0.5 mol. % bromide, average grain diameter 0.6 μm) prepared from 0.58 g of $AgNO_3$ with
1.08 g of gelatine
0.52 g of magenta coupler M-1
0.24 g of dye stabiliser ST-2
0.10 g of dye stabiliser ST-3
0.25 g of dibutyl adipate
0.25 g of isooctadecanol Layer 5: (UV protective layer)
1.15 g of gelatine
0.2 g of UV absorber UV-1
0.2 g of UV absorber UV-2
0.2 g of oil former OF-3
0.07 g of compound SC-1
0.07 g of compound SC-2
0.04 g of TCP Layer 6: (Red-sensitive layer)
Red-sensitised silver halide emulsion (99.5 mol. % chloride, 0.5 mol. % bromide, average grain diameter 0.5 μm) prepared from 0.30 g of $AgNO_3$ with
0.75 g of gelatine
0.2 g of UV absorber UV-1
0.36 g of cyan coupler C-1
0.12 g of dye stabiliser ST-4
0.24 g of TCP Layer 7: (UV protective layer)
0.35 g of gelatine
0.15 g of UV absorber UV-3
0.15 g of oil former OF-4

Layer 8: (Protective layer)
0.9 g of gelatine
0.3 g of hardener H-1

The following compounds were used in the layer structure of Example 1:

Y-1

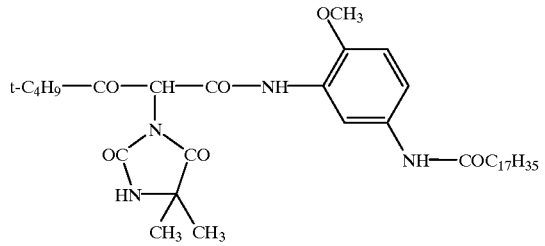

C-1

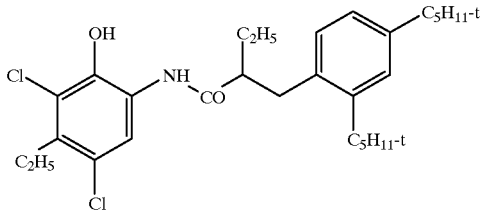

-continued
M-1
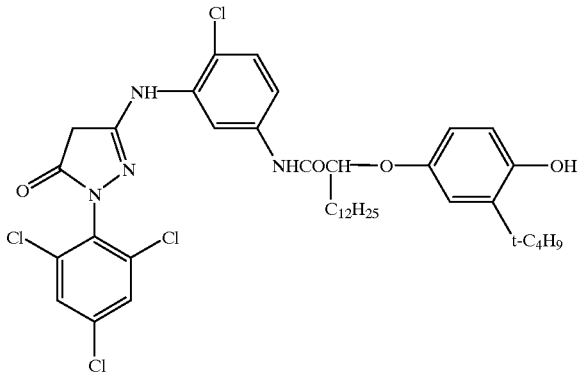
W-1
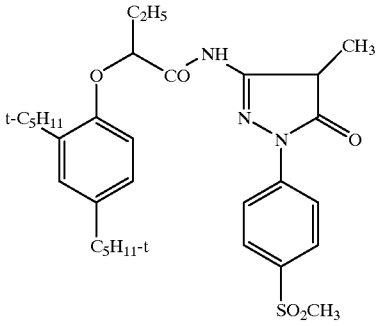
ST-1
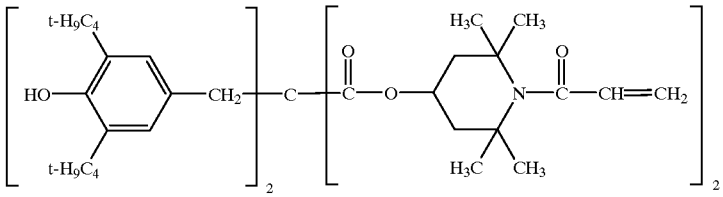
ST-2
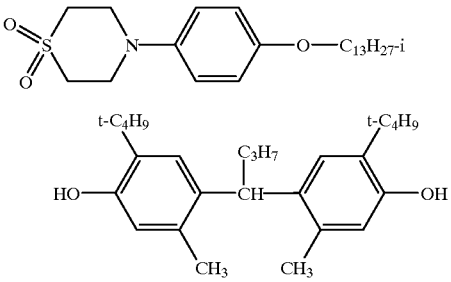
ST-3
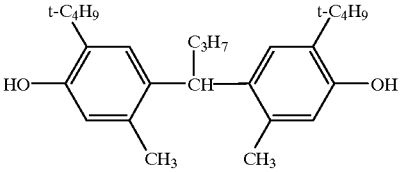

-continued
ST-4
1:2-mixture prepared from
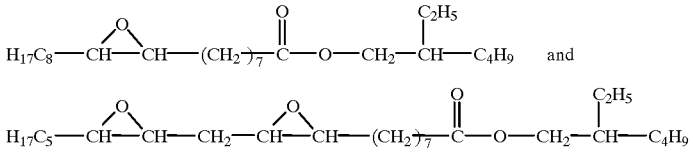
and
OF-1
Adipic acid polyester with 1,3-butanediol and 1,4-butanediol
OF-2
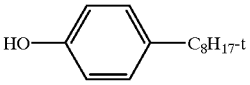
OF-3
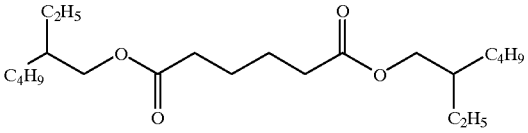
OF-4
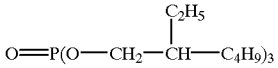
SC-1
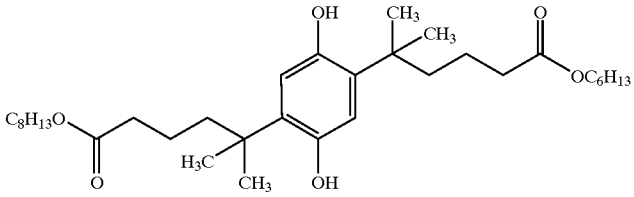
SC-2
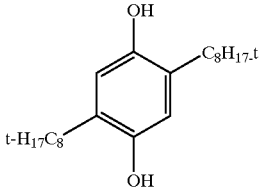
UV-1
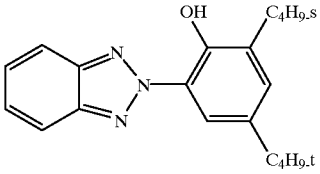
UV-2
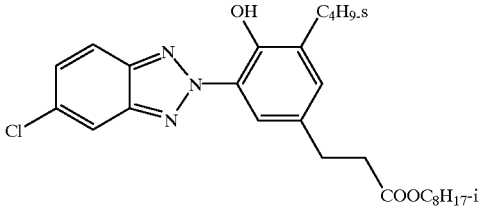

-continued

UV-3

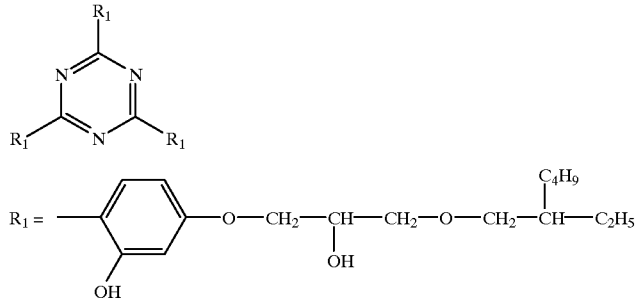

H-1

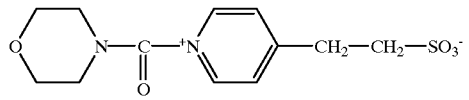

Samples 2 to 14

Samples 2 to 14 were produced in the same manner as sample 1, except that compounds Y-1, SC-1, SC-2 and M-1 in layers 2, 3, 4 and 5 were replaced by those stated in table 1. Moreover, the applied quantity of silver in layer 4 was reduced to 0.28 g in samples 4 to 9 and to 0.22 g in samples 10 to 14.

TABLE 1

(C: comparison; I: invention) [Quantity in mg/m$^2$]

| Sample no. | Layer 2 | | Layers 3 & 5 | | Layer 4 | |
|---|---|---|---|---|---|---|
| 1 (C) | Y-1 | [550] | SC-1/SC-2 | [70/70] | M-1 | [520] |
| 2 (I) | Y-1 | [550] | I-1 | [140] | M-1 | [520] |
| 3 (I) | Y-1 | [550] | I-5 | [140] | M-1 | [520] |
| 4 (C) | Y-1/Y-2 | [450/100] | SC-1/SC-2 | [70/70] | M-2 | [250] |
| 5 (C) | Y-1/Y-2 | [450/100] | SC-3 | [140] | M-2 | [250] |
| 6 (I) | Y-1/Y-2 | [450/100] | I-4 | [140] | M-2 | [250] |
| 7 (I) | Y-1/Y-2 | [450/100] | I-12 | [140] | M-2 | [250] |
| 8 (I) | Y-1/Y-2 | [450/100] | I-24 | [140] | M-2 | [250] |
| 9 (I) | Y-1/Y-2 | [450/100] | I-26 | [140] | M-2 | [250] |
| 10 (C) | Y-3 | [520] | SC-2 | [140] | M-3 | [140] |
| 11 (C) | Y-3 | [520] | SC-3 | [140] | M-3 | [140] |
| 12 (I) | Y-3 | [520] | I-9 | [140] | M-3 | [140] |
| 13 (I) | Y-3 | [520] | I-15 | [140] | M-3 | [140] |
| 14 (I) | Y-3 | [520] | I-28 | [140] | M-3 | [140] |
| 15 (I) | Y-3 | [520] | I-30 | [150] | M-3 | [140] |

One sample of each was exposed through a grey wedge with blue, green or red light and processed as follows:

| a) Colour developer - 45 s - 35° C. | |
|---|---|
| Tetraethylene glycol | 20.0 g |
| N,N-diethylhydroxylamine | 4.0 g |
| (N-ethyl-N-(2-methanesulphonamidoethyl)-4-amino-3-methylbenzene sulphate | 5.0 g |
| Potassium sulphite | 0.2 g |
| Potassium carbonate | 30.0 g |
| Polymaleic anhydride | 2.5 g |
| Hydroxyethanediphosphonic acid | 0.2 g |
| Optical brightener (4,4'-diaminostilbene sulphonic acid derivative) | 2.0 g |
| Potassium bromide | 0.02 g |

make up with water to 1000 ml; adjust pH value to pH=10.2 with KOH or $H_2SO_4$.

| b) Bleach/fixing bath - 45 s - 35° C. | |
|---|---|
| Ammonium thiosulphate | 75.0 g |
| Sodium hydrogen sulphite | 13.5 g |
| Ethylenediaminetetraacetic acid (iron-ammonium salt) | 45.0 g |

make up with water to 1000 ml; adjust pH value to pH 6.0 with ammonia (25%) or acetic acid.

c) Rinsing—2 min—33° C.

d) Drying

The percentage cyan density ($D_{cyan}$) at a magenta density ($D_{magenta}$) of 1.0 was then determined on the sample exposed with green light (table 2). All the samples were then exposed to the light from a daylight-standardised xenon lamp and irradiated with $15\times10^6$ lux·h. The percentage reduction in density $\Delta D_{yellow}$, $\Delta D_{magenta}$ and $\Delta D_{cyan}$ after irradiation was determined at initial density D =1.0 (table 2).

TABLE 2

| Sample no. | % $D_{cyan}$ at $D_{magenta}$ = 1.0 | $\Delta D_{yellow}$ [%] | $\Delta D_{magenta}$ [%] | $\Delta D_{cyan}$ [%] |
|---|---|---|---|---|
| 1 (C) | 10.1 | −32 | −28 | −36 |
| 2 (I) | 9.9 | −23 | −27 | −27 |
| 3 (I) | 9.8 | −24 | −27 | −28 |
| 4 (C) | 7.5 | −34 | −59 | −35 |
| 5 (C) | 8.6 | −25 | −34 | −26 |
| 6 (I) | 7.3 | −22 | −32 | −27 |
| 7 (I) | 7.6 | −24 | −32 | −27 |
| 8 (I) | 7.5 | −23 | −33 | −26 |
| 9 (I) | 7.2 | −23 | −34 | −27 |
| 10 (C) | 5.6 | −44 | −31 | −35 |
| 11 (C) | 6.3 | −30 | −16 | −28 |
| 12 (I)P | 5.7 | −28 | −14 | −26 |
| 13 (I) | 5.4 | −30 | −15 | −27 |
| 14 (I) | 5.5 | −29 | −16 | −27 |
| 15 (I) | 5.4 | −27 | −15 | −26 |

As table 2 shows, the compounds according to the invention effectively prevent co-coupling without having a disadvantageous effect on colour stability.

Compounds used for the first time in samples 2 to 14:

Y-2
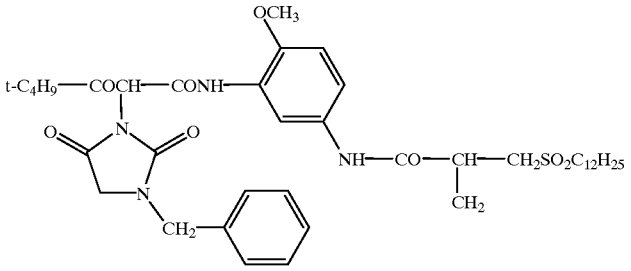
Y-3
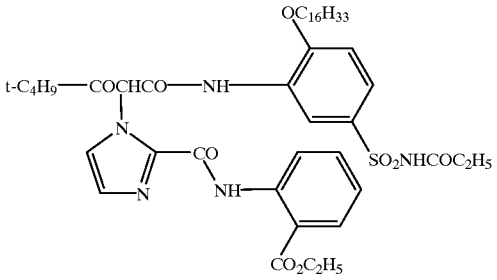
M-2
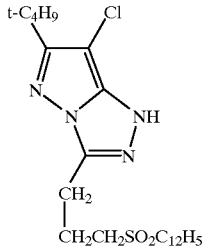
M-3
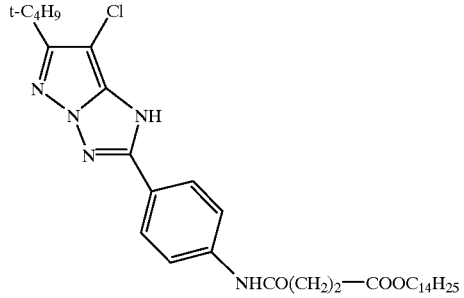
SC-3
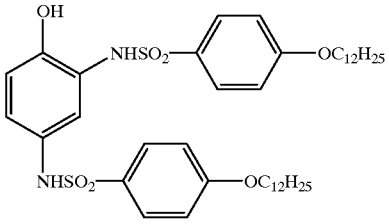

EXAMPLE 2

A colour photographic recording material for colour negative development was produced (sample 15, comparison), by applying the following layers in the stated sequence onto a 120 μm thick, transparent cellulose triacetate film support provided with a coupling layer. Quantities are stated in g/m$^2$. The applied quantity of silver halide is stated as the corresponding quantities of $AgNO_3$. All the silver halide emulsions were stabilised with 0.1 g of 4-hydroxy-6-methyl-1,3,3a,7-tetraazaindene per 100 g of $AgNO_3$. The silver halide emulsions are characterised by the composition of the halide, and, with regard to grain size, by the median particle size by volume (VSP). The median particle size by volume has the dimension of a length [μm] and is determined using the equation:

$$VSP = \frac{\sum n_i d_i^4}{\sum n_i d_i^3}$$

wherein $n_i$ means the number of particles in the range i and $d_i$ means the diameter of spheres of an identical volume for the particles in the range i.

| | |
|---|---|
| Layer 1: (Anti-halo layer) | |
| Black colloidal silver | 0.28 |
| UV absorber UV-2 | 0.20 |
| Gelatine | 0.8 |
| Layer 2: (Low sensitivity, red-sensitised layer) | |
| Red-sensitised silver bromide-iodide-chloride emulsion (2.4 mol. % iodide; 10.5 mol. % chloride; VSP 0.35) | 0.85 |
| Gelatine | 0.6 |
| Cyan coupler C-2 | 0.3 |
| Coloured coupler CR-1 | $2.0 \times 10^{-2}$ |
| Coloured coupler CY-1 | $1.0 \times 10^{-2}$ |
| DIR coupler DIR-1 | $1.0 \times 10^{-2}$ |
| Layer 3: (Medium sensitivity, red-sensitised layer) | |
| Red-sensitised silver bromide-iodide emulsion (10.0 mol. % iodide; VSP 0.56) | 1.2 |
| Gelatine | 0.9 |
| Cyan coupler C-2 | 0.2 |
| Coloured coupler CR-1 | $7.0 \times 10^{-2}$ |
| Coloured coupler CY-1 | $3.0 \times 10^{-2}$ |
| DIR coupler DIR-1 | $4.0 \times 10^{-2}$ |
| Layer 4: (High sensitivity, red-sensitised layer) | |
| Red-sensitised silver bromide-iodide emulsion (6.8 mol. % iodide; VSP 1.2) | 1.6 |
| Gelatine | 1.2 |
| Cyan coupler C-3 | 0.15 |
| DIR coupler DIR-3 | $3.0 \times 10^{-2}$ |
| Layer 5: (Interlayer) | |
| Gelatine | 1.0 |
| Layer 6: (Low-sensitivity, green-sensitised layer) | |
| Green-sensitised silver bromide-iodide-chloride emulsion (9.5 mol. % iodide; 10.4 mol. % chloride; VSP 0.5) | 0.66 |
| Gelatine | 0.9 |
| Magenta coupler M-4 | 0.3 |
| Coloured coupler MY-1 | $2.0 \times 10^{-2}$ |
| DIR coupler DIR-1 | $5.0 \times 10^{-3}$ |
| DIR coupler DIR-2 | $1.0 \times 10^{-3}$ |
| Oxform scavenger SC-2 | $5.0 \times 10^{-2}$ |
| Layer 7: (Medium-sensitivity, green-sensitised layer) | |
| Green-sensitised silver bromide-iodide-chloride emulsion (10.0 mol. % iodide; VSP 0.56) | 1.4 |
| Gelatine | 0.9 |
| Magenta coupler M-4 | 0.24 |
| Coloured coupler MY-1 | $4.0 \times 10^{-2}$ |
| DIR coupler DIR-1 | $5.0 \times 10^{-3}$ |
| DIR coupler DIR-2 | $3.0 \times 10^{-3}$ |

-continued

| | |
|---|---|
| Layer 8: (High-sensitivity, green-sensitised layer) | |
| Green-sensitised silver bromide-iodide emulsion (6.8 mol. % iodide; VSP 1.1) | 1.7 |
| Gelatine | 1.2 |
| Magenta coupler M-5 | $3.0 \times 10^{-2}$ |
| Coloured coupler MY-2 | $5.0 \times 10^{-2}$ |
| DIR coupler DIR-3 | $5.0 \times 10^{-2}$ |
| Layer 9: (Interlayer) | |
| Polyvinylpyrrolidone | $10^{-2}$ |
| Gelatine | 0.4 |
| Layer 10: (Yellow filter layer) | |
| Yellow colloidal silver sol | 0.1 |
| Gelatine | 0.8 |
| Layer 11: (Low-sensitivity blue-sensitised layer) | |
| Blue-sensitised silver bromide-iodide emulsion (6.0 mol. % iodide; VSP 0.78) | 0.4 |
| Gelatine | 1.0 |
| Yellow coupler Y-4 | 0.4 |
| DIR coupler DIR-1 | $3.0 \times 10^{-2}$ |
| Layer 12: (Medium-sensitivity, blue-sensitised layer) | |
| Blue-sensitised silver bromide-iodide-chloride emulsion | |
| (8.8 mol. % iodide; 15.0 mol. % chloride; VSP 0.77) | 0.12 |
| (12.0 mol. % iodide; 15.0 mol. % chloride; VSP 1.0) | 0.28 |
| Gelatine | 0.77 |
| Yellow coupler Y-4 | 0.58 |
| Layer 13: (High-sensitivity, blue-sensitised layer) | |
| Blue-sensitised silver bromide-iodide emulsion (12.0 mol. % iodide; VSP 1.2) | 1.2 |
| Gelatine | 0.9 |
| Yellow coupler Y-4 | 0.1 |
| DIR coupler DIR-3 | $2.0 \times 10^{-2}$ |
| Layer 14: (Protective layer) | |
| Micrate silver bromide-iodide emulsion (4.0 mol. % iodide; VSP 0.05) | 0.25 |
| UV absorber UV-4 | 0.2 |
| UV absorber UV-2 | 0.3 |
| Gelatine | 1.4 |
| Layer 15: (Hardening layer) | |
| Gelatine | 0.2 |
| Hardener H-1 | 0.86 |
| Persoftal | 0.04 |

Compounds used in Example 2:

C-2

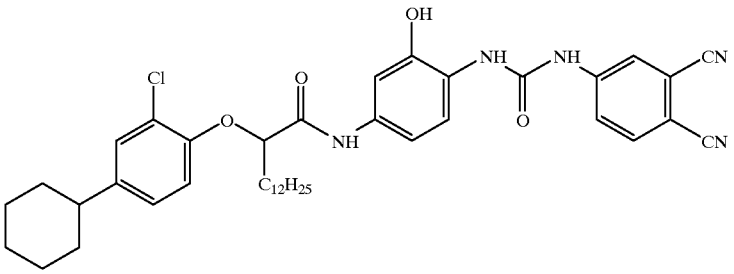

-continued
C-3
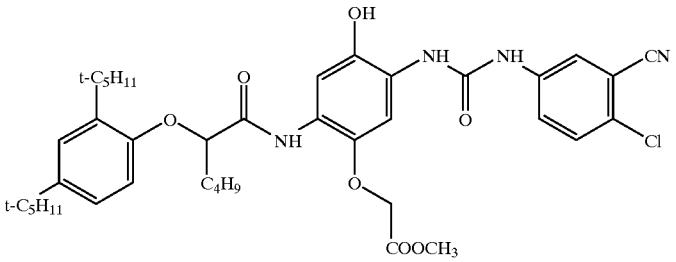
CR-1
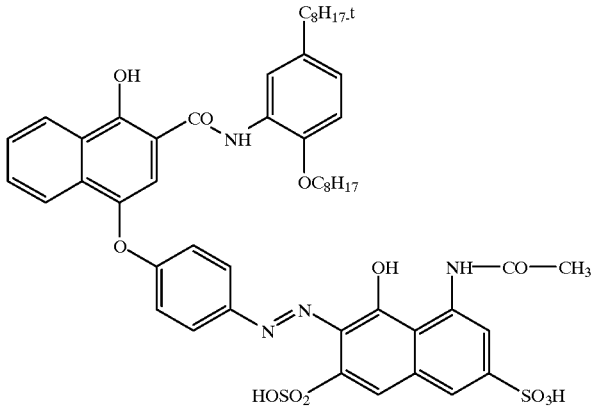
CY-1
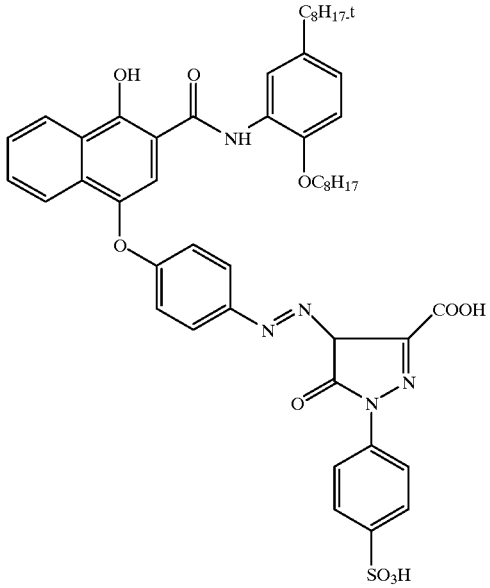

-continued
M-4
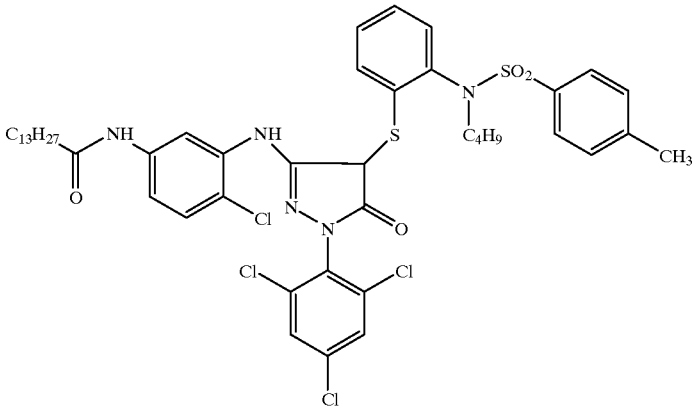
M-5
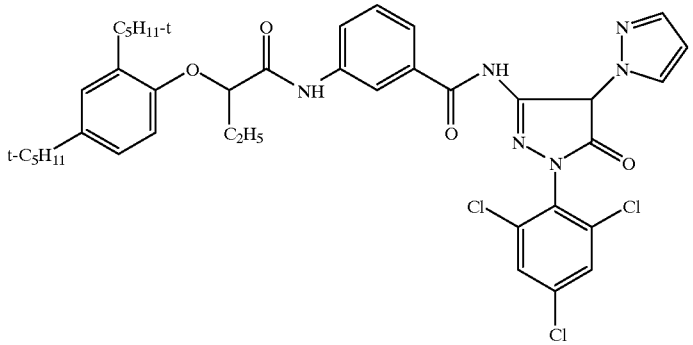
MY-1
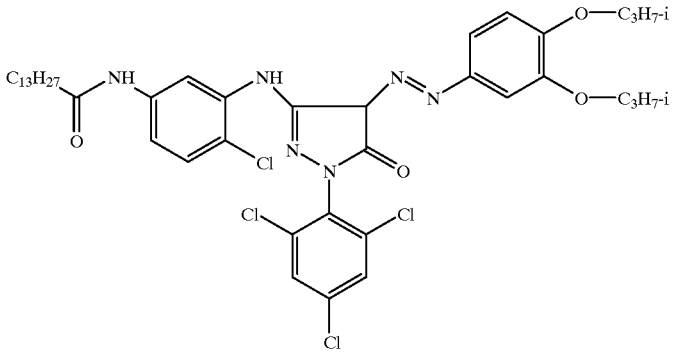
MY-2
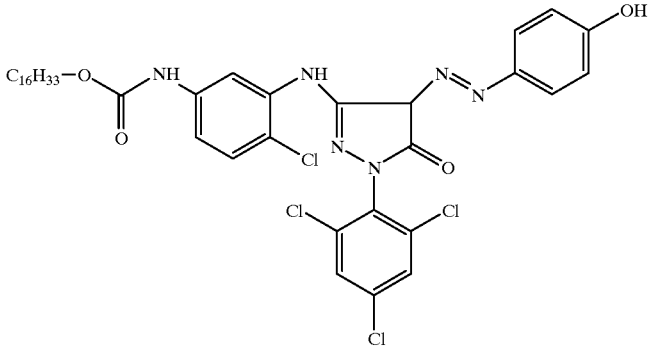

-continued
Y-4
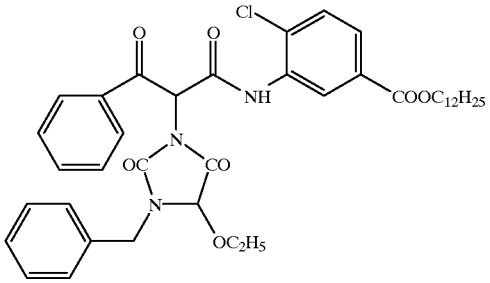
DIR-1
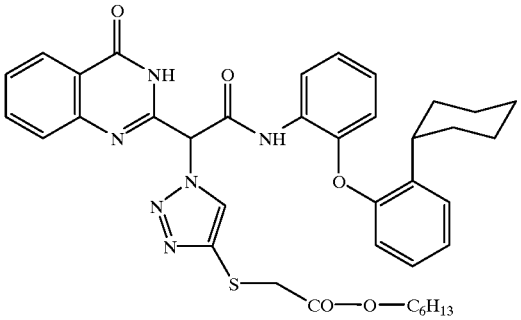
DIR-2
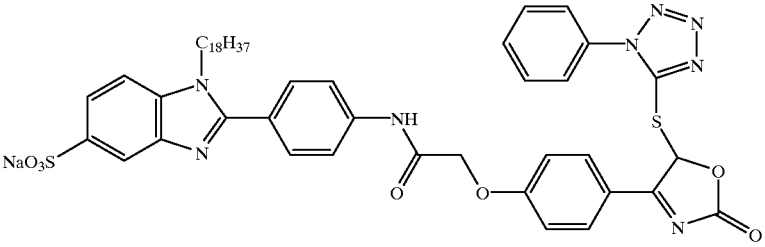
DIR-3
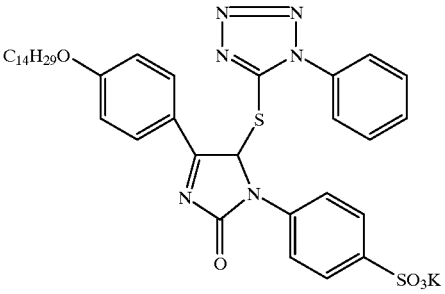
UV-4
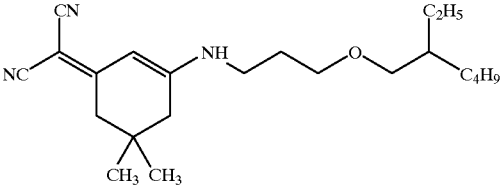

The colourless and coloured couplers were each incorporated together with the same quantity of tricresyl phosphate (TCP) using known prior art emulsification methods.

Samples 16 to 18

The samples differ from sample 15 in that they additionally contain compounds of the formula (I) (g/m$^2$) in layer 1. The samples were then exposed with daylight through a graduated grey wedge. The materials were then processed using the process described in E. Ch. Gehret, *The British Journal of Photography* 1974, p. 597. Relative red sensitivity and cyan fog were measured on the resultant samples. Table 3 shows the results.

TABLE 3

| Sample | Compound in the 1st layer | Quantity | Relative red sensitivity | Cyan fog | |
|---|---|---|---|---|---|
| 15 | — | — | 100 | 0.30 | Comparison |
| 16 | I-4 | 0.200 | 123 | 0.21 | Invention |
| 17 | I-10 | 0.160 | 129 | 0.18 | Invention |
| 18 | I-27 | 0.250 | 123 | 0.20 | Invention |

Samples 19 to 24

Samples 19 to 24 differ from sample 15 in that 0.125 mmol of the compounds listed in table 4/m$^2$ were additionally used in layer 5. Samples 23 and 24 instead respectively contained white couplers W-1 and W-2 in a quantity of 0.125 mmol/m$^2$.

The samples were processed in the same manner as samples 15 to 18. Relative magenta density $D_1$ was then measured at point E+logH after 3 days' storage at 20° C. and $D_2$ after 3 days' storage at 60° C./90% relative humidity and the difference $D_2-D_1$ and magenta fog ($D_{min}$) after storage at room temperature were determined (E was determined at point 0.2 above fog). Table 4 shows the results:

TABLE 4

| Sample | Compound | $D_{min}$ | $D_2$-$D_1$ | |
|---|---|---|---|---|
| 15 | none | 0.70 | 0.25 | Comparison |
| 19 | I-4 | 0.48 | 0.20 | Invention |
| 20 | I-10 | 0.51 | 0.21 | Invention |
| 21 | I-25 | 0.51 | 0.23 | Invention |
| 22 | I-27 | 0.49 | 0.23 | Invention |
| 23 | W-1 | 0.50 | 0.68 | Comparison |
| 24 | W-2 | 0.51 | 0.83 | Comparison |

White coupler W 2 is of the formula:

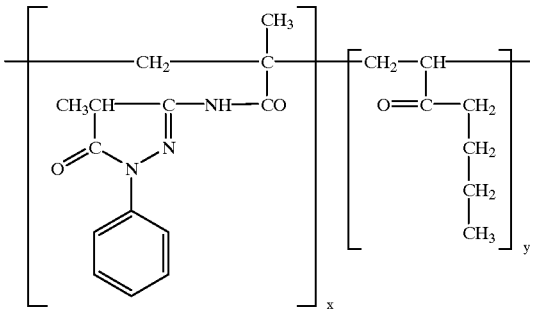

x = 73 wt.%
y = 27 wt.%

It may be seen from the results in table 4 that the compounds according to the invention reduce magenta fog without there being an increase in the difference $D_2-D_1$. The difference $D_2-D_1$ is a measure of the stability of the developed image as information may be deduced from it concerning changing print conditions on storage of the developed colour negative image.

We claim:

1. A color photographic silver halide material which comprises a support and at least one silver halide emulsion layer which contains at least one compound of the formula (I)

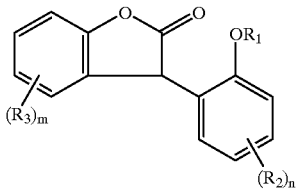

(I)

in which $R_1$ is hydrogen alkyl or acyl, $R_2$ and $R_3$ mutually independently are alkyl, cycloalkyl, alkenyl, aryl, halogen, $OR_4$, $SR_5$, $NR_6R_7$, nitro, cyano, $SO_2R_8$, $COOR_9$, $COR_{10}$ or hetaryl, $R_4$, $R_5$ and $R_9$ mutually independently are alkyl, cycloalkyl, alkenyl, aryl or hetaryl, $R_6$and $R_7$ mutually independently are H, $R_4$, $COR_{10}$, $COOR_9$, $SO_2R_8$, $R_8$ and $R_{10}$ mutually independently are alkyl, cycloalkyl, alkenyl, aryl, hetaryl or $NR_6'R_7'$ $R_6'$ and $R_7'$ mutually independently are H, $R_4COR_{10'}$, $COOR_9$, $SO_2R_{8'}$ wherein $R_{8'}$ and $R_{10'}$ mutually independently are alkyl, cycloalkyl, alkenyl, aryl or hetaryl, n, m mean 0, 1, 2, 3 or 4 or two residues $R_2$ or $R_3$ may each mean a fused carbo-or heterocyclic ring or the compounds of formula I are linked to a polymer chain via $R_1$, $R_2$ or $R_3$.

2. The color photographic silver halide material according to claim 1, wherein $R_1$ is hydrogen or acyl, $R_2$ is identical to $R_3$ and m is identical to n.

3. The color photographic silver halide material according to claim 1, wherein $R_1$ is hydrogen and $R_2$ and $R_3$ are alkyl, wherein the sum of C atoms in the alkyl residues $R_2$ and $R_3$ is greater than 8.

4. The color photographic silver halide material according to claim 1, wherein the compounds of the formula (I) are used in a quantity of 5 to 1000 mg/m$^2$ of material.

5. The color photographic silver halide material according to claim 1, wherein the silver halide material contains silver chloride-bromide emulsions containing above 95 mol. % of AgCl.

6. The color photographic silver halide material according to claim 5, wherein the material contains at least one green-sensitive silver halide emulsion layer containing a magenta coupler and the compounds of the formula (I) are used in at least one layer adjacent to the green-sensitive silver halide emulsion layer.

7. The color photographic silver halide material according to claim 6, wherein the magenta coupler is a pyrazolotriazole magenta coupler.

8. The color photographic silver halide material according to claim 1, wherein at least one of the residues $R_2$ and $R_3$ is located in para position relative to the phenolic oxygen.

9. The color photographic silver halide material according to claim 1, wherein the formula (I) is

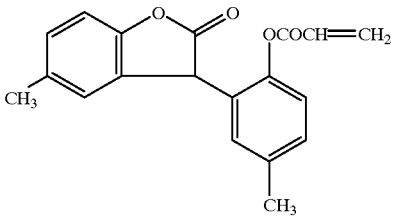
or
-continued
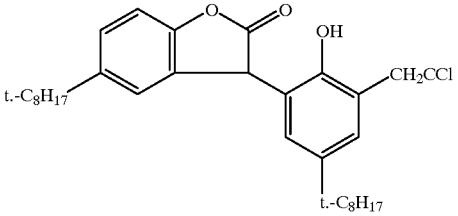
10. The color photographic silver halide material according to claim 4, wherein the compounds of the formula (I) are used a quantity of 10 to 500 mg/mg2.
* * * * *